United States Patent [19]

Linde

[11] 4,148,572

[45] Apr. 10, 1979

[54] KEYBOARD CONTROLLED PHOTOTYPESETTING MACHINE

[75] Inventor: Hans Linde, Berlin, Fed. Rep. of Germany

[73] Assignee: H. Berthold AG, Fed. Rep. of Germany

[21] Appl. No.: 792,564

[22] Filed: May 2, 1977

[30] Foreign Application Priority Data

May 4, 1976 [DE] Fed. Rep. of Germany ... 7614382[U]

[51] Int. Cl.[2] ..... B41B 17/04; B41B 21/08

[52] U.S. Cl. ..... 354/15; 354/12; 354/14; 354/19

[58] Field of Search ..... 354/5, 12, 13, 14, 15, 354/16, 19, 292

[56] References Cited

U.S. PATENT DOCUMENTS

| | | | |
|---|---|---|---|
| 3,011,421 | 12/1961 | Sausele | 354/292 |
| 3,688,672 | 9/1972 | Hanson et al. | 354/16 |
| 3,754,452 | 8/1973 | Walstrom | 354/15 |

*Primary Examiner*—Russell E. Adams

*Attorney, Agent, or Firm*—Basile and Weintraub

[57] ABSTRACT

The invention concerns a keyboard controlled phototypesetting machine or the typesetting of text, preferably of the same letter type and letter size, and which consists of a light source with projection optic, a symbol carrier and a movable film transport carrier which can be loaded with a cassette with light-sensitive material, as well as a typesetting computer for the conrol of the typesetting.

3 Claims, 5 Drawing Figures

KEYBOARD CONTROLLED PHOTOTYPESETTING MACHINE

BACKGROUND OF THE INVENTION

I. Field of the Invention

The present invention relates to phototypesetting machines and, in particular, to a keyboard controlled phototypesetting machine.

II. Description of the Prior Art

For the manufacture of text from the manuscript to the typeset product or printed product, the printing industry uses various phototypesetting installations and machines from manual title typesetting equipment with optical control and keyboard control or directly controlled phototypesetting machines, to phototypesetting machines which are controlled by means of typesetting computers or data carriers, into the so-called CRT high-performance phototypesetting installations with a performance of several millions of symbols per hour. The medium sized phototypesetting machines show a performance of between 50,000 and 250,000 symbols per hour, whereas the performance of the keyboard controlled phototypesetting machines without data carriers is dependent substantially on the speed of the operator.

As far as the directly controlled or keyboard controlled phototypesetting machines are concerned, a substantial number of these machines are used for the so-called exercise work, that is, this is no volume typesetting, such as for books, journals, etc., but individually shaped typesetting with several letter sizes and letter types, such as is necessary for pamphlets, catalogs, forms, etc. The construction of these phototypesetting machines is therefore complicated and expensive with regard to the mechanical and electronical building blocks so they can dispose at any time over a larger supply of symbols of different letter types which are projectable by means of variable optics in the form of various letter sizes. It is an intrinsic quality of these machines, as well as the phototypesetting machines which can be controlled with a data carrier (punch card or magnetic tape), to show a very high degree of flexibility for very different requirements.

III. Prior Art Statement

The aforementioned prior art includes, in the opinion of the applicant, the closest prior art of which applicant is aware.

SUMMARY OF THE INVENTION

The special object of the present invention is the construction of a phototypesetting machine which is of simple construction, compact and of low price with a slowing rotating symbol carrier for the preparation of simple text with possibly the same type of letter and size of letters, which is characterized by an especially simple operation and especially by ready service ability.

This object is met by the characterizations of claim 1.

Advantageous further modifications and other versions of this solution of the problem are evident from the description and drawings.

By means of use of very simple, partially known building elements and their special locations with reference to each other, a very compact phototypesetting machine results with high requirements regarding quality, which phototypesetting machine shows approximately the size of a typewriter where an exchangeable disk is used as a symbol carrier depending on the type and the size of the letters which are used and where certain groups of letters will repeat each other several times in a circle.

This keyboard controlled phototypesetting machine can be used completely independently in small or medium sized printing shops, advertising companies or other graphical art companies for the performance of various phototypesetting work. Principally, the machine can be advantageously employed as a supplement for larger phototypesetting machines for expensive typesetting work. This phototypesetting machine is mainly constructed for the purpose of typesetting of simple text of the same type of letter and size of letter where always two types of letters are used directly. Both types of letters can preferably have the same size of letter. For each basic letter, a second letter is directly used which is either cursive or a bold letter, such as, for instance, to give emphasis to numbers.

BRIEF DESCRIPTION OF THE DRAWINGS

The invention will now be described in detail using the attached drawings which show a version as an example, and wherein.

DESCRIPTION OF THE PREFERRED EMBODIMENT

Figure 1:
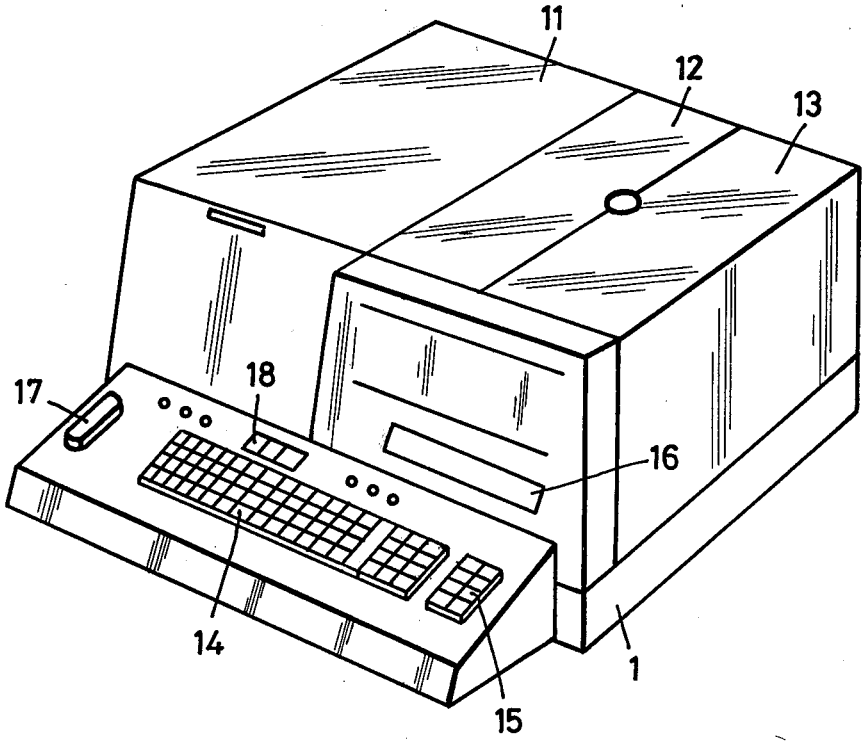
FIG. 1 is a perspective view of a phototypesetting machine constructed in accordance with the principles of the present invention.

The phototypesetting machine 1 is enclosed in a housing 11 with a door 12, for the exchange of the symbol carrier, and the door 13, for the removal of the exposed photo material and for the insertion of a supply cassette which contains new, unexposed photo material. The machine can be operated by means of a conventional typewriter keyboard 14 with corresponding additional keys for special symbols and with the control switches and adjustment switches 15 which are located separately from the conventional typewriter keyboard 14. The operation of the machine is simple and uncomplicated and does not require any special technical training such that the machine can be safely handled by a normal typist after a short period of training. A special characteristic of the keyboard consists of the fact that several different keyboard arrangements are provided by electronic storage in each machine which correspond to each of the user's national keyboard arrangements. In this way, for example, five Anglo-Germanic and five Romanic keyboard arrangements are stored such that merely by plugging in or exchanging a few key heads and simultaneously operating a code switch, any other keyboards can be programmed at any time, which will still be explained in detail later on.

In addition, it is possible with this phototypesetting machine to convert the phototypesetting machine for another language, such as Japanese, etc., by exchange of a program chip and exchange of the key heads with some additional devices.

The machine is equipped with a so-called "display" 16 in the form of an electronic visual indicator. All symbols, as well as all entered control signals, can be viewed on this electronic view indicator in the form of capital and small letters. During typesetting the operator can view the entered symbols up to, for example, 30 seconds and can control his work visually.

Next to the keyboard there is an exchangeable fixed data storage 17 which is also known as a "Dicktenbox" from which a typesetting computer, which is integrated into the phototypesetting machine, can receive the basic widths which belong to each symbol or letter. This basic width shows the actual one width or letter widths for each symbol which is identical with each symbol carrier and the letter size which can be controlled in every machine. For another letter size of the same type of letter, one has only to exchange the symbol carrier and to indicate this letter size with a switch.

The problem of optimum word width arrangement in connection with a digital display and acoustical and optical signals is solved with special advantage in the present phototypesetting machine. Generally and usually the spaces between the words can be adjusted for a very certain range of a minimum or a maximum value. In this case each width between the words during the typesetting of a line is first stored as minimum value for the length of a line, and the typesetter can control, by means of a display, to which extent each line has been filled already in such a way that he can finish or eliminate this line ahead of the adjusted width of the line. These phototypesetting machines distribute automatically the remaining rest of the line over the existing spaces between the words according to one of the usual processes of elimination. Thus, in most cases the space between the words is increased in a suitable fashion, starting from a minimum value; that is, depending on the remaining rest of the line. However, this results in a typographically irregular appearance of the distances between words within the eliminated lines. For keyboard control machines it is a common practice that the keyboard is blocked, and therefore a symbol cannot be entered anymore when the typesetter has reached the end of the line which was set at the machine. In this case he has to erase some symbols by means of erasing keys, and he can eliminate only after he has done this.

In case of the present phototypesetting machine in contrast the typesetter can always determine the optimum space between the words by means of a digital display 18 and an acoustical-optical signal, or the optimum space between the words is indicated for the typesetter. The typesetter can then select a more narrow or a wider space between the words as was originally set, and in this way he can influence and optimize the space between the words in two directions. The typographically optimum space between the words which corresponds to the letter size is always selected and displayed in this machine. At the same time the machine registers each space between the words as a minimum value which cannot be seen by the typesetter. The minimum value can be approximately half the size of the optimum space between the words. The machine also registers a maximum value which is still justifiable. The number of the spaces between the words per line times the maximum value will now indicate to the typesetter, acoustically and optically, when to eliminate. After this he can continue with the typesetting work and can fill the line via the digital display to such an extent until the display agrees with the selected widths of the line. The typesetter can also put more symbols on this line up to a value which results from the minimum value times the number of the spaces between the words, if this should be necessary, for technical typesetting reasons. The keyboard is blocked only when this value is exceeded.

Furthermore, the present phototypesetting machine contains a three-way switch within the keyboard. With this switch the machine can carry out the necessary separations at the end of the line in three different ways. According to the first way, the typesetting of the text or the typing is performed like on a typewriter until the first acoustical signal is heard; then a so-called hyphen or separating line is entered through the keyboard. For the second option it is proceeded in such a way that the acoustical signal is sounded before the selected end of the line, and then the last word is completely entered by insertion of a hyphen at each possible point of separation. The word is then automatically separated by the machine; that is, it is separated at one of the separation points, and the rest of the word is put at the beginning of a new line. According to the third option of the switch, a text can be continuously, that is, one word after the other, entered into the phototypesetting machine; and the typesetter does not have to pay attention to the end of the line. Each line is separated with satisfactory precision by means of a syllable separating program which is part of the machine.

Figure 2:
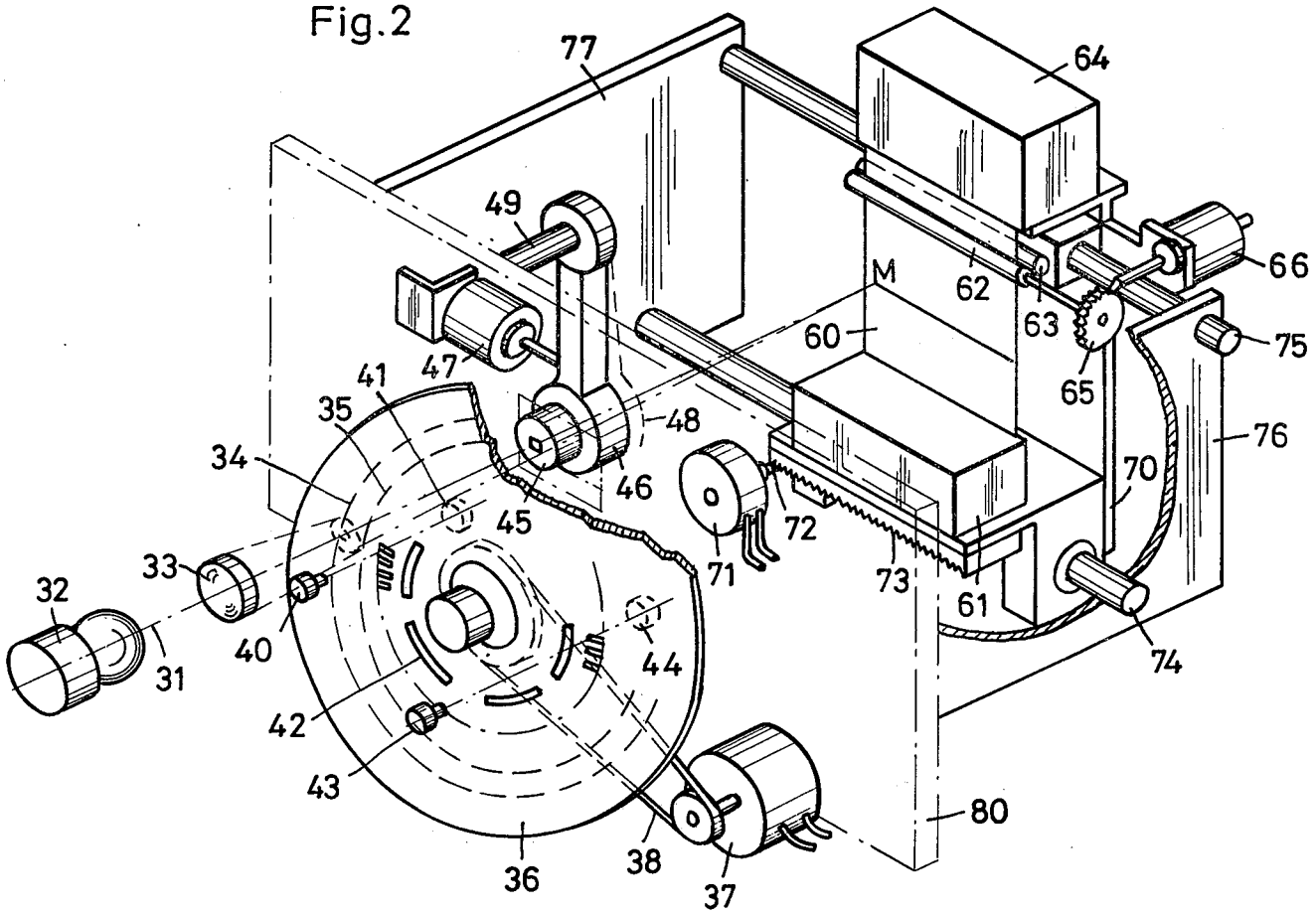
FIG. 2 illustrates the internal construction of the phototypesetting machine.

FIG. 2 shows the internal construction of the phototypesetting machine according to FIG. 1. An impulse light source 32 is attached inside the housing of the machine and is located on the optical axis 31. This impulse light source 32 is used for the actual exposure. The beam of light from the impulse light source 32 illuminates completely always two symbols on a symbol carrier 36 by means of a condenser 33. The two symbols are located on two different concentric rings 34, 35 of the disk shaped symbol carrier 36. Each of these rings carries a large number of letters or similar symbols which are spaced and distributed over its circumference. The symbol carrier 36 is continuously kept in motion by a motor 37 and a belt 38. It is advantageous if the letter disk 36 rotates relatively slowly in order to be able to work with two satisfactory flash times of the impulse light source 32 without having to use relatively expensive, highly sensitive photo material or without lack of quality with regards to the quality of the image. If the speed of revolutions of the symbol carrier is somewhat reviewed, a higher typographic quality will result; and the rate of typesetting, which anyhow depends on the manual entry, is hardly impaired. This is achieved in such a way that in each of both of the symbol rings 34 and 35 the at least ten most occurring letters of the alphabet occur as a repeating group at least five times at the circumference. In one advantageous version the most frequently occurring thirteen letters are used which correspond to a proportion of 85% of all used symbols in a normal text. In this way, for example, a symbol of this group, which was selected by the typesetting computer, will run five times through the point of exposure during one revolution. For each symbol or letter there exists flash marks 39 for the control of the moment at which the flash should occur. The flash marks 39 activate an optical system which consists of a light source 40 and a receiver 41. Furthermore, marks 42 for the repeat groups exist on the symbol carrier, which marks can be detected by the light source 43 and the receiver 44. An opening 45 limits the passage of the light flash to a symbol of only one of the rings 34 or 35 that is selected such that only one symbol is correctly focused by means of a lens 46 on a light sensitive material 60. The lens 46 has a fixed focal length and cannot be moved longitudinally with reference to the optical axis 41, but can only be swung by means of a magnet 47 into a second position 48 perpendicular to the optical axis 31 around the axis 49 at the attachment together with the opening 45, where each of the turning positions permits the projection of one symbol in one of the two symbol rings 34 or 35. The light sensitive material 60 is transported from a supply container 61 through the rollers 62 and 63 into a removal cassette 64, which is closed and does not allow the entry of light. For this purpose, the roller 62 can be set in motion by means of the rachet gear 65 and a lifter magnet 66 or similar step motors.

A film transport carrier 70 is moved in its entirety by means of a motor 71 with cog wheel 72, as well as cog bar 73, in longitudinal direction with reference to the axes 74, 75 which serve as bearings for the carrier. The movement is controlled by the typesetting computer in accordance with the width which belongs to each symbol.

The lifter magnet 66 is attached to the transport carrier 70 which effects the transport of the light sensitive material in the direction of the sequence of lines that is perpendicular with reference to the advancing symbols. This transport can be carried out at any position of the transport carrier 70 and at any time and also in any intermediate position perpendicular to the direction of the parallel axes 74 and 75. Both the axes 74 and 75 are attached to supports 76 and 77 which, in turn, are attached at one of their sides to the central support wall 80. On the other side of the support wall 80 the symbol carrier 36 and motor 37, as well as the light source 32 and questioning unit, are also attached. Therefore, the support wall is the central basis for the mechanical and optical total construction of the phototypesetting machine.

Figure 3:
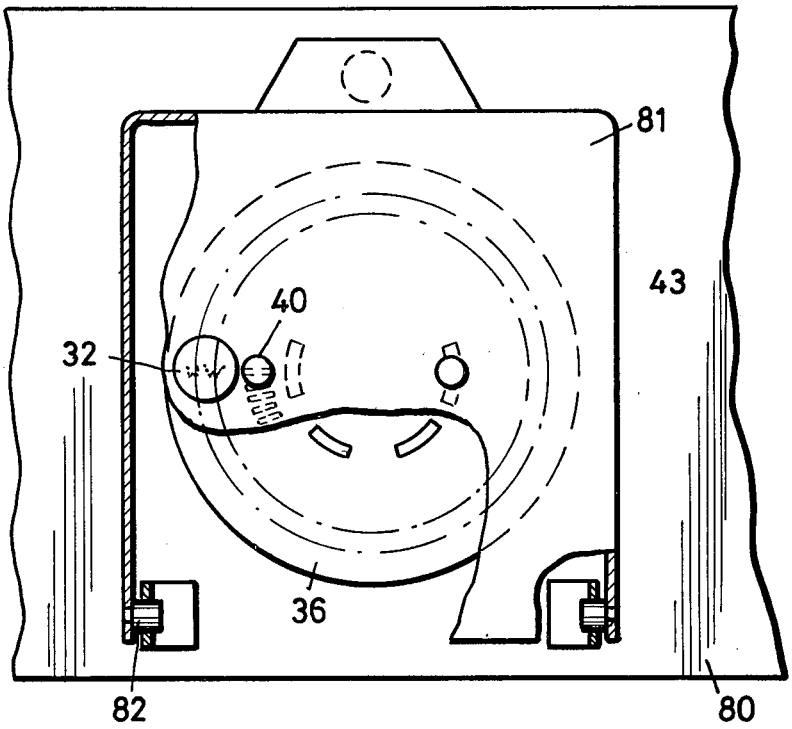
FIG. 3 illustrates the flash unit and questioning unit.
Figure 4:
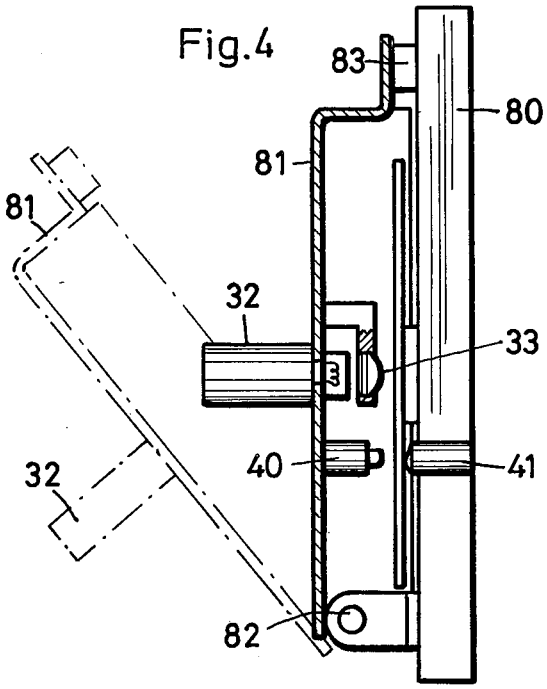
FIG. 4 is a cross-section of the flash unit.

FIGS. 3 and 4 show a view from the top and a cross section of the flash unit and the questioning unit and reveal constructional details of these units. The symbol carrier 36 is centered at the support ball 80 by means of a bearing, which is not shown. The symbol carrier 36 is readily removable from the supporting ball 80. The flash unit 32 with the condenser 33 and the light source 40 with the receiver 43 for the flash mark 39 and repeat group marks 42 are attached to a door 81 which can be turned at an axis 82 in the way shown. If a symbol carrier 36 should be exchanged, the door 81 including the exposure unit and the questioning unit are turned away in such a way that the symbol carrier is readily accessible. The door 81 can be maintained in its operational position, for instance, by means of a magnet 83.

FIG. 4 shows the flash mark questioning unit 40, 41 offset for reasons of improved clearness and lucidity.

Figure 5:
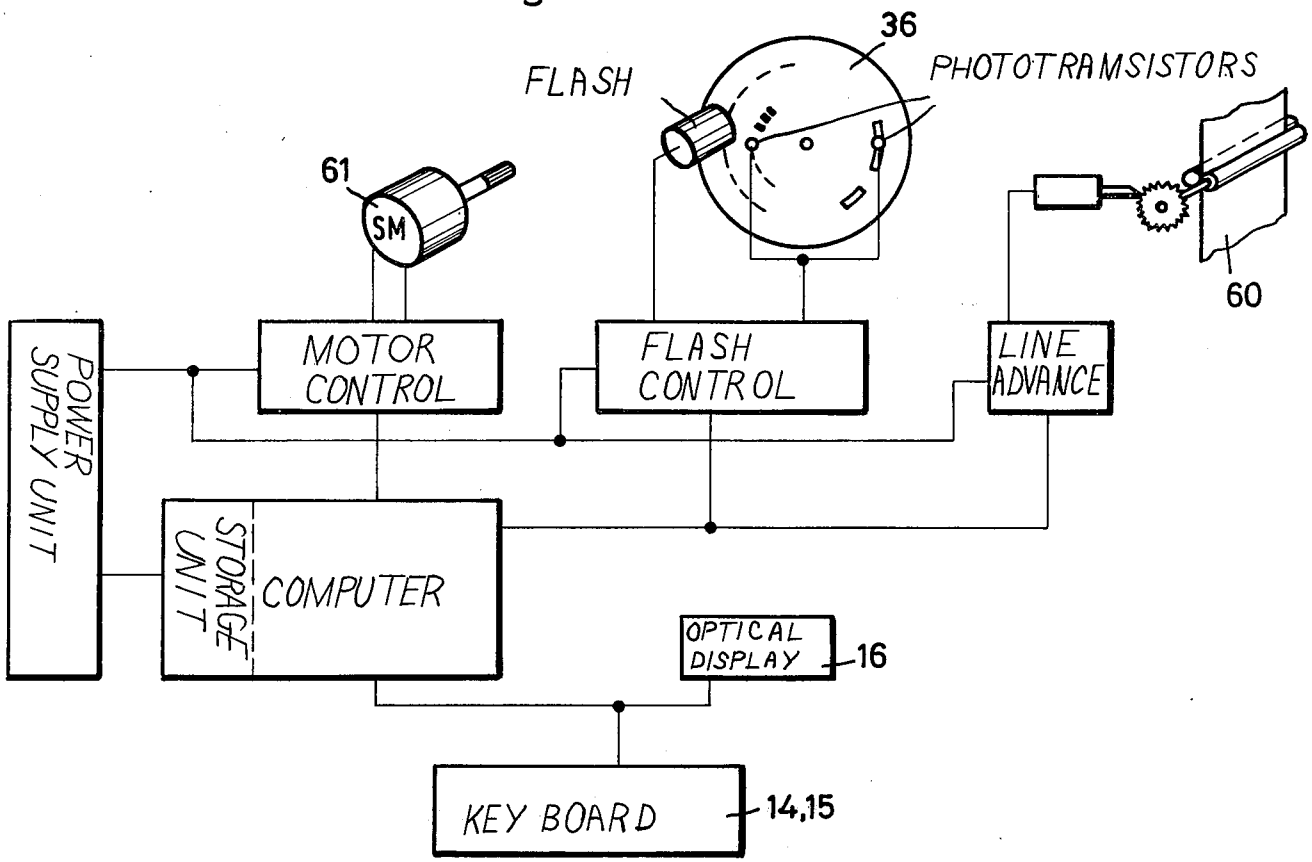
FIG. 5 is a wiring plan for the control of the phototypesetting machine.

FIG. 5 shows a schematic wiring diagram for the control of the phototypesetting machine.

The following example shows the operation of the phototypesetting machine;

At first all the necessary typesetting information, such as letter size, type of typesetting, type of letter, etc., are entered at the corresponding switches of the keyboard 14, 15 and are optically displayed at the display 16 and are stored in the computer and storage unit. The power supply unit supplies the necessary energy for the computer, the control of the motor, the flash control and the advance of the line. When the typesetter starts with the entering of the letters or lines, they will be stored by the computer in the storage unit independent on the type of letter and the size of the letter. When the desired width of the line has been reached, the actual spaces between the words are calculated by the computer and stored. Now the actual typesetting work is done by exposing the letters and symbols to a flash by means of the flash unit control in the moment of their exact position on the optical axis, and in this way the light sensitive material 60 is exposed. Then the entire film transport carrier 70 (FIG. 3) is moved by the step motor 71 by a distance which corresponds to the width of the symbol which has just typeset. The photo-transistors and the symbol carrier 36 register each passing of a flash mark 39 and the marks 42 which correspond to the repeat groups. In this way the computer, in combination with the storage unit, controls each symbol which should be exposed with regard to the shortest time of revolution of the symbol carrier 36. After a line has been typeset, the computer activates the advance of the line and simultaneous return of the film transport carrier 70.

It can thus be seen that the present invention has provided a new and improved keyboard controlled phototypesetting machine.

It should be understood by those skilled in the art of keyboard controlled phototypesetting machines that other forms of applicant's invention may be had, all coming within the spirit of the present invention and scope of the appended claims.

What is claimed is as follows:

1. The keyboard controlled phototypesetting machine for the typesetting of texts of preferably uniform letter type and letter size consisting of a light source with display optic, a continuously rotating exchangeable symbol carrier and a light-sensitive material which is inside a cassette in a movable film transport carrier, characterized by the fact that the entirety of the constructional elements of the phototypesetting machine are attached or supported by a central supporting wall where the optical display system and the symbol carrier are located on the one side of the support wall, and the film transport carrier with its transport mechanism is located on the opposite side of the supporting wall;

said light source continuously lighting two symbols at one time on said symbol carrier, a fixed focus lens movable by means of a magnet from one position to a second position thereby selecting one of said two symbols for focusing on a common point at the copying plane.

2. The device according to claim 1 characterized by the fact that an opening selecting a symbol and the lens are located at the free end of a turnable lever and that each of both of its turning positions is located in the display axis of a symbol on one of the two symbol rings.

3. The device according to claim 1 characterized by the fact that the at least ten most used letters of the alphabet are located on each of both of the symbol rings in the form of repeat groups.

* * * * *

UNITED STATES PATENT AND TRADEMARK OFFICE

CERTIFICATE OF CORRECTION

PATENT NO. : 4,148,572

DATED : April 10, 1979

INVENTOR(S) : Hans Linde

It is certified that error appears in the above-identified patent and that said Letters Patent are hereby corrected as shown below:

In the Abstract, line 7, "conrol" should be --control--;

Column 4, line 37, take out "letter" and before "36" insert --shaped symbol carrier--;

Column 4, line 47 "the" (1st occurrence) should be --that--;

Column 4, line 60, after "carrier," insert --36--;

Column 4, line 68, "41" should be --31--;

Column 5, line 38, take out "ball" and insert --wall--;

Column 5, line 40, take out "ball" and insert --wall--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*